US007528332B1

(12) United States Patent
Via et al.

(10) Patent No.: US 7,528,332 B1
(45) Date of Patent: May 5, 2009

(54) HIGH SPEED ACTUATING DEVICE AND CIRCUIT BREAKER

(75) Inventors: Lester C. Via, Springfield, VA (US); Dennis W. Massey, Markham, VA (US)

(73) Assignee: Utron Inc., Manassas, VA (US)

( * ) Notice: Subject to any disclaimer, the term of this patent is extended or adjusted under 35 U.S.C. 154(b) by 420 days.

(21) Appl. No.: 11/280,505

(22) Filed: Nov. 16, 2005

Related U.S. Application Data

(60) Provisional application No. 60/628,119, filed on Nov. 17, 2004.

(51) Int. Cl.
*F04B 39/00* (2006.01)
*F04B 53/00* (2006.01)

(52) U.S. Cl. ..... 200/82 B; 417/312

(58) Field of Classification Search ..... 417/312
See application file for complete search history.

(56) References Cited

U.S. PATENT DOCUMENTS 4,166,375 A * 9/1979 Stepantsov et al. ..... 72/430
4,174,471 A 11/1979 Ford et al.
4,224,487 A 9/1980 Simonsen
4,298,101 A 11/1981 Dressell, Jr. et al.
4,311,890 A 1/1982 Schroder
4,345,127 A 8/1982 Niemeyer
4,384,182 A 5/1983 Imam
4,658,629 A * 4/1987 Milisavljevic ..... 72/453.02
5,187,339 A 2/1993 Lissandrin
6,767,505 B2 * 7/2004 Witherspoon et al. ..... 419/45
2004/0265161 A1 * 12/2004 Witherspoon et al. ..... 419/52

* cited by examiner

*Primary Examiner*—Elvin G Enad
*Assistant Examiner*—Lheiren Mae A Anglo
(74) *Attorney, Agent, or Firm*—James Creighton Wray

(57) ABSTRACT

A device for rapidly moving mechanically actuated devices, such as switches and valves with the capability of sub-millisecond response times being achievable with moving masses exceeding one kilogram. Response times approaching that of explosively actuated devices are obtained while retaining the repetitive cycling capability of non-explosively operated devices. Electrical energy stored in a capacitor pulses through electrodes and closed and open ends of a capillary tube to rapidly heat a gas and raise its pressure to a thousand atmospheres or more. The high pressure gas acts on a piston, accelerating it for a short distance before the pressure is vented around the piston to quickly reduce the drive force. The moving piston is brought to a stop by a hydraulic damping device. A reset device resets the piston, the capillary is refilled with working gas, and the capacitor is charged fro the next operation.

26 Claims, 5 Drawing Sheets

HIGH SPEED ACTUATING DEVICE AND CIRCUIT BREAKER

This application claims the benefit of U.S. Provisional Application No. 60/628,119, filed Nov. 17, 2004, which is hereby incorporated by reference in its entirety.

FIELD OF THE INVENTION

The present invention relates to high speed pressure driven actuators suitable for valves and electrical switch mechanisms, particularly devices having relatively massive moving parts that can benefit by the high forces generated to obtain fast response times.

BACKGROUND OF THE INVENTION

Many applications exist for high speed valves and switches such as circuit breakers and other safety related devices that must respond quickly to prevent catastrophic equipment damage. Some of these applications may have relatively large moving masses that are difficult to move quickly because of the large forces needed.

Prior art, such as Lissandrin, U.S. Pat. No. 5,187,339, uses pneumatic pressure to move a piston, but piston acceleration is limited by the pressure used and the speed at which the gas can flow into the piston's cylinder. Prior art such as Imam, U.S. Pat. No. 4,384,182, use hydraulic pressure to move a piston, but like pneumatically driven devices, the speed is limited by pressure and the speed of the driving fluid.

Yet other prior art, such as Ford et al., U.S. Pat. No. 4,174,471, Niemeyer, U.S. Pat. No. 4,345,127, Schroder, U.S. Pat. No. 4,311,890, and Simonsen, U.S. Pat. No. 4,244,487 achieve great speed through the use of explosive charges, but are limited to one-shot applications because the device is destroyed upon actuation.

Actuating devices intended for repetitive operation must survive each actuation without damage. The moving parts of fast acting devices must be accelerated to relatively high velocities and thus acquire substantial kinetic energy that must be absorbed to bring the parts to a stop in the actuated position. Consequently, once the moving parts have achieved the needed velocity, the accelerating force must be replaced with a decelerating force. Prior systems make no provision for quickly removing the accelerating force and simply allow the moving parts to strike a fixed mechanical stop. While prior methods work without problems when velocities are relatively slow, at high velocities a fixed mechanical stop results in severe stresses that cause permanent deformation and store energy in a spring like action. Neither severe permanent deformation nor spring action are acceptable as repeated deformation causes the parts to fracture, while any spring action causes the moving parts to bounce back toward the initial position with little loss of kinetic energy. Without some provision for quickly removing the accelerating force and absorbing the kinetic energy, destructive forces will destroy a mechanical stop.

While a variable orifice hydraulic shock absorber intended to bring a moving mass to a stop can be used, prior art in these devices such as Dressell, Jr. et al., U.S. Pat. No. 4,298,101, are not intended to operate at the velocities needed for speeds that approach that of explosively actuated devices. It would be difficult to provide orifices large enough to prevent excessive hydraulic pressures from being generated.

Needs exist for high speed valves and switches that respond quickly to prevent catastrophic equipment damage.

SUMMARY OF THE INVENTION

The present invention achieves speeds approaching that of explosive actuated devices while retaining a repetitive operation capability of conventional pneumatic or hydraulic actuated devices. The speed is achieved by suddenly increasing the pressure of a gas that is already behind a piston by suddenly heating it to extreme temperatures, eliminating the time needed for fluid to flow through the orifice of a valve. An initial gas pressure of 100-200 psi may be increased more than a hundredfold within tens of microseconds by an electrical discharge using energy stored in a capacitor, nearly as fast and as forceful as the detonation of an explosive charge.

Once the actuator's moving parts have accelerated to the desired velocity, the accelerating force is suddenly reduced by allowing the driving gas pressure to also be felt on both sides of the drive piston. A step in the diameter of the drive cylinder bore allows the driving gas to leak around the piston once the piston has entered the area of the larger bore.

The deceleration of the moving parts is accomplished through the use of a hydraulic shock absorber. The shock absorber continually increases its resistance to movement as the moving parts move deeper into the actuated position. This allows the decelerating force to be maintained as the moving parts slow down. At high velocities, this can be accomplished using a simple mechanism that is basically a leaky piston. The hydraulic fluid passes though the clearance gap between the piston and cylinder. The variable orifice is achieved by using a tapered cylinder bore that provides a relatively large gap at one end that tapers to virtually no gap at the other end.

The present invention is a high speed actuating apparatus that includes a capillary device that further includes an energy storage capacitor, a high voltage pulse generator connected to the energy storage capacitor, an electrode connected to the high voltage pulse generator, an anode connected to the electrode, a capillary housing having a closed end and an open end and holding the anode near the closed end, a capillary liner within the capillary housing, a capillary volume within the capillary liner, and a cathode at the open end of the capillary device opposite the electrode. A housing encloses the open end of the capillary device. A drive cylinder is located within the housing. A working gas is located within the drive cylinder and the capillary volume. A drive piston is located within the drive cylinder. A damper cylinder is connected to the housing. A damper piston is located within the damper cylinder. Hydraulic fluid is located within the interior volume, and a shaft connects the drive piston to the damper piston.

The present invention may also include a drive cylinder pressure port for introducing working gas into the drive cylinder, or a pressure equalization passage through the drive piston.

The drive cylinder may have a step increase in bore diameter. The drive piston may have an enlarged portion within the increased bore that is segmented like the petals of a flower.

The present invention also has a reset source for resetting the drive piston near the open end of the capillary housing. The damper cylinder has a tapered bore. The capillary liner is shrunk fit into the capillary housing. The high voltage pulse generator is an inductor.

The present invention may also include a pressure equalization passage through the drive piston for ensuring the working gas in the drive cylinder fills the capillary volume.

In another preferred embodiment, a high speed actuator and high speed switch apparatus includes a capillary tube having a capillary housing, a capillary insulating liner within the capillary housing, a capillary volume within the capillary liner, a closed end and an open opposite end of the capillary tube, an energy storage capacitor, a high voltage switch connected to the energy storage capacitor, a first electrode connected to the high voltage switch and mounted within the capillary volume, an anode connected to the electrode, and a second electrode near the open end of the capillary tube opposite the first electrode. A drive housing encloses the open cathode end of the capillary tube. A drive cylinder is located within the drive housing. A working gas is located within the drive cylinder and the capillary tube. A drive piston is located within the drive cylinder. A damper cylinder connects to the drive housing. A damper piston is located within the damper cylinder. Hydraulic fluid is located within the damper cylinder. A shaft connects the drive piston to the damper piston. A drive cylinder pressure port connects to the drive housing for introducing working gas into the drive cylinder. A pressure equalization passage is located through the drive piston. A high speed switch connects to the shaft for operating the high speed switch when the drive piston drives the shaft away from the capillary tube, and a reset connects to the shaft for driving the shaft toward the capillary tube.

In the present invention, the drive cylinder has a smaller bore near the capillary tube, an outward step at an end of the smaller bore away from the capillary tube, and a larger bore extending from the step. The drive piston has a first smaller section fitting in the smaller bore and a second larger section fitting in the larger bore. The second larger section has spaced edge portions for flowing working gas around the driving piston.

The damper cylinder has a sloping bore sloping inward from a larger bore section toward the capillary tube for slowing flow of the hydraulic fluid around the damper piston as the damper piston travels away from the capillary tube.

The high speed switch comprises a shaft extension on the shaft, a conductor on the shaft extension, a shaft extension housing on the shaft extension and first and second spaced contacts in the shaft extension housing for bridging the contacts with the conductor.

The shaft extension housing surrounds the shaft extension, the conductor is a conductive sleeve on the shaft extension, and wherein the spaced contacts are annular and surround the shaft extension. The high speed switch is a circuit breaker, wherein the conductive sleeve bridges and connects the contacts when the shaft and the drive piston are in a reset position near the capillary tube, and further comprising an insulating contact separator and an arc quencher in the shaft extension housing between the annular contacts. The reset further comprises a reset chamber surrounding an end of the shaft extension remote from the capillary tube and a gas port connected to the reset chamber for moving the shaft toward the capillary chamber and into the reset position.

The present invention is also a method of high speed actuating that includes providing a capillary tube with a capillary housing, a capillary liner within the capillary housing, a capillary volume within the capillary liner, a closed end and an open end of the capillary tube opposite the electrode closed end, providing an energy storage device, providing a high voltage switch connecting the high voltage switch to the energy storage device, providing a first electrode in the closed end of the capillary tube and connecting a conductor to the high voltage switch and connecting the first electrode to the conductor, providing a second electrode at the open end of the capillary tube, providing a housing enclosing the open cathode end of the capillary tube, providing a drive cylinder within the housing, providing a damper cylinder connected to the housing, providing a damper piston within the damper cylinder, providing a shaft connecting the drive piston to the damper piston, filling the drive cylinder within the housing and the capillary volume with a working gas, filling the damper cylinder with hydraulic fluid, operating the high voltage switch, heating and expanding the working gas in the capillary volume by discharging electrical energy from the energy storage device between the first and second electrodes, accelerating the drive piston from an initial position with the expanding working gas, flowing the expanding working gas around the drive piston, decelerating the drive piston with hydraulic force on the damper piston, and returning the drive piston to the initial position by applying a reset force to the shaft.

The providing the high voltage switch comprises providing a high voltage pulse generator, wherein the providing the first and second electrodes comprises providing an anode at the closed end and providing an annular cathode at the open end.

The method also includes providing the drive piston with a step increase in bore diameter away from the capillary tube, and wherein the drive piston has a complementary step increase in diameter, and further comprising providing the increased diameter portions of the drive piston and passageways cooperating between the drive cylinder for flowing expanding working gas around the drive piston.

The method also includes providing a tapered bore in the damper cylinder tapering away from the drive cylinder, shrink fitting the capillary housing around the capillary liner, providing a pressure equalization passage through the drive piston for ensuring the working gas fills the capillary volume from the drive cylinder, and providing spaced contacts around the shaft, providing a conductive sleeve on the shaft for spanning the spaced contacts for moving the sleeve with the shaft with respect to the contacts to complete or break a circuit between the contacts and the sleeve, providing an arc suppressor surrounding the shaft for suppressing an arc when the shaft moves the sleeve out of contact with one of the contacts.

These and further and other objects and features of the invention are apparent in the disclosure, which includes the above and ongoing written specification, with the drawings.

DETAILED DESCRIPTION OF THE PREFERRED EMBODIMENTS

The present invention is a piston driven actuator where the drive pressure is created by suddenly heating gas that is already behind the piston rather than opening a valve and allowing a high pressure gas or hydraulic fluid to flow toward the piston. The sudden heating method by increasing pressure eliminates the delays caused by a valve's response time and the delays caused by a finite flow velocity of the driving fluid as it moves through a valve's orifice. The heating process is accomplished by the sudden discharge of electrical energy stored in a large capacitor or capacitor bank, creating an explosive release of energy behind the driving piston.

Figure 1:
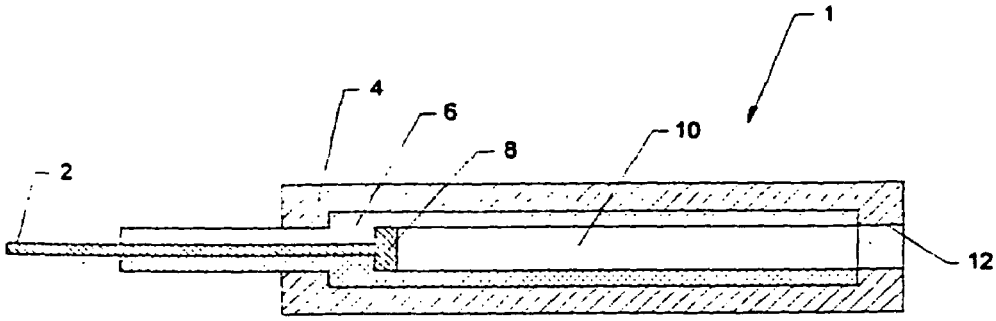
FIG. 1 is a cross sectional view of a basic capillary discharge device.

The sudden heating of a working gas occurs in a capillary tube discharge device. FIG. 1 depicts a simplified capillary tube 1 used to aid in understanding the heating process. The capillary tube 1 consists of a conductive capillary housing 4, preferably, but not limited to, steel, surrounding an insulating capillary liner 6. A conductive high voltage electrode 2 leads to an anode 8 at one end of the capillary tube 1. An opposite end 12, is open to an otherwise enclosed volume 10 containing the working gas, usually, but not limited to, argon.

A high voltage impulse is applied to the electrode 2 which causes strong a voltage gradient between the anode 8 and the capillary housing 4. The voltage gradient is high enough to ionize the working gas at the capillary liner's 6 surface near the anode 8. Since the ionized gas is conductive, a high voltage gradient always exists in the unionized gas just forward of the ionized portion, causing the further breakdown of more of the working gas. The ionization process continues along the surface of the capillary liner 6 until it reaches the cathode end 12 of the capillary housing 4. As the gas breakdown progresses along the capillary liner's 6 surface, a current flows though the ionized portion of the working gas to charge the capacitance between the capillary liner's 6 surface and the capillary housing 4, thus, keeping the gas near the surface ionized. Once the ionization process reaches the cathode 12, a low impedance path exists between the high voltage electrode 2 and the capillary housing 4. The current through the capillary tube 1 increases to a value limited by the impedance of the source of the high voltage impulse. The ionized layer or plasma at the surface of the capillary liner 6 grows in thickness to accommodate the increased current flow.

Extremely low source impedance is required to ionize virtually all gas within the capillary volume 10 and is seldom achieved. The working gas is heated to a high temperature, typically about 8,000 to 13,000 Kelvin, with a corresponding increase in gas pressure. Gas not heated directly by the electrical discharge is compressively heated by the expanding plasma. The heating process occurs so quickly that the working gas is inertially confined. Little of the gas escapes out the open cathode end 12 of the capillary device 1 before peak temperatures are obtained due to the finite speed of the shock wave that forms the transition between the hot, high pressure capillary gas and cold, low pressure gas just beyond the electrical discharge path at the cathode end 12.

The high temperatures reached by the working gas, if maintained too long, will ablate any material used for the capillary liner 6. The ablation of a polymer, such as polycarbonate, has the advantage of providing additional working gas, but ablation results in limited life for the capillary liner 6. Ceramics such as boron nitride, can handle considerable energy without ablation as long as the ablation threshold is not exceeded, providing much longer life. Repetitively fired capillary devices with ceramic liners have lasted more than a million shots. Increasing the initial working gas pressure also reduces the ablation of the liner. The capillary liner 6 surface is not heated instantaneously, but increases at a finite rate during the heating process. If the gas cools quickly enough after all energy is released, the sublimation or vaporization temperature of the capillary liner 6 material will not be exceeded. However, many applications exist, such as circuit breakers that protect against rarely occurring faults, which can tolerate some ablation without reducing the lifetime below acceptable levels.

Figure 2:
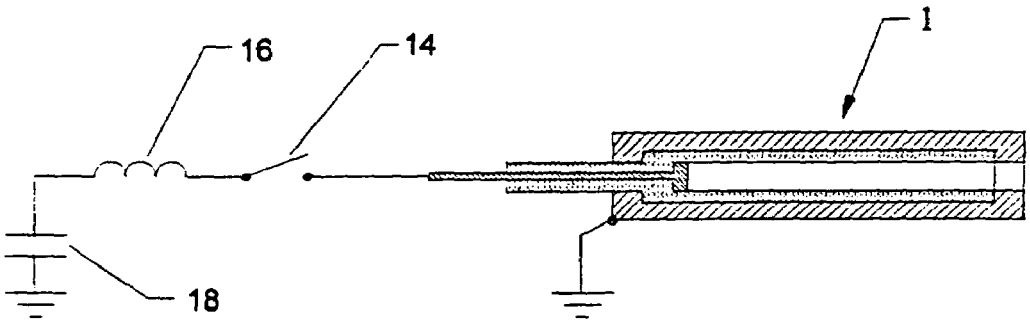
FIG. 2 is schematic diagram of a basic capillary discharge circuit.

FIG. 2 depicts the schematic diagram of a basic circuit used to drive a capillary device 1. Energy is stored in a capacitor 18 that is charged to a voltage high enough to initiate the ionization process previously described, typically about 40-50 kilovolts. A high voltage switch 14 is then closed to trigger the discharge. An inductor 16 represents stray circuit inductance plus any additional inductance that may be added to obtain the desired discharge pulse waveform characteristics. Ideally, the electrical resistance of the conducting capillary should form a critically damped circuit with the capacitor 18 and the inductor 16. This is difficult with this circuit since the impedance of the capillary, once conducting, is very low. The low impedance results in an under-damped ringing current waveform that wastes energy in the internal resistance of the capacitor 18 and the inductor 16.

Figure 3:
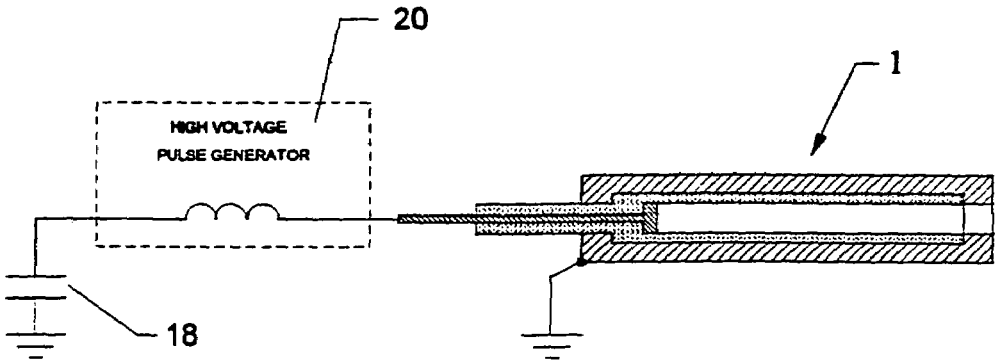
FIG. 3 is a schematic diagram of a preferred capillary discharge circuit.

FIG. 3 depicts an improved circuit, capable of greater efficiency over that shown in FIG. 2. Like FIG. 2, the circuit has an energy storage capacitor 18, but the inductor is the series inductance of a high voltage pulse generator. The advantage of this circuit is that the capacitor 18 does not have to be charged to a voltage high enough to fire the capillary, allowing the use of a lower voltage higher value capacitor to store the needed energy. The much higher value capacitor eases the problem of obtaining a critically damped circuit with the low capillary resistance. A high voltage pulse generator suitable for this purposed is capable of generating high voltages in only a few turns of large diameter wire, thus inserting only a very low inductance in series with the energy storage capacitor 18, typically about 5-10 uH.

The optimum current pulse shape is one that appears similar to a critically damped waveform in that little overshoot or undershoot is observed near its end. The capillary voltage drop is nearly independent of the current while conducting the discharge. Charging the capacitor 18 to around twice this voltage usually produces the desired current waveform. A capacitor value should be selected that provides the needed energy when charged to this voltage. The voltage drop between the capillary's anode and cathode is typically around 400 volts per inch of discharge length when argon at about 150 psig is used as the working gas. This voltage drop is also a function of gas pressure, increasing somewhat with a pressure increase.

Figure 4:
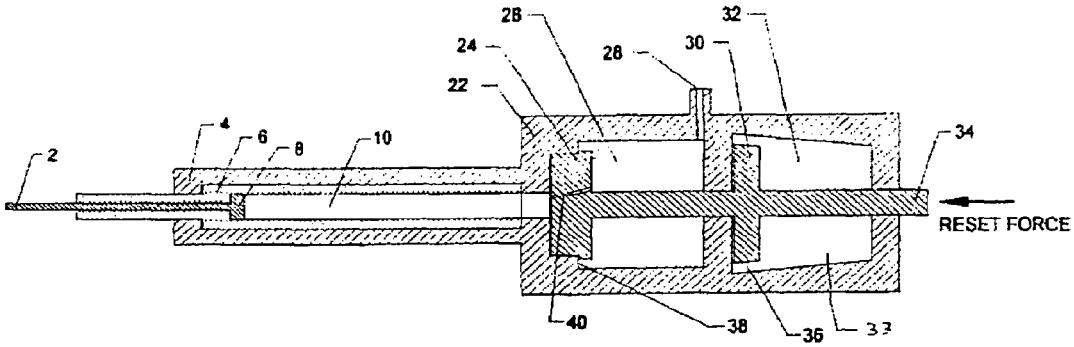
FIG. 4 is a simplified representation of a basic capillary driven actuator in its initial position.

The actuator mechanism is formed as shown in FIG. 4 by adding a working piston 24 and damper piston 30 to the capillary device. The housing 22 enclosing the drive piston 24 has a step increase 38 in bore diameter so that once the drive piston 24 moves a short distance the working gas expelled from the capillary interior volume 10 moves around the drive piston 24 and applies pressure to both sides, which significantly reduces the drive force after the initial pressure pulse. The working gas is introduced through the drive cylinder pressure port 28. The working gas fills the drive cylinder volume 26 as well as the capillary volume 10. A pressure equalization passage 40 can be put in the drive piston to assure the working gas can move into the capillary volume 10 rather than depend on leakage around the drive piston. However, this passage must be a small enough diameter so that only a small amount of the working gas moves though it during the drive piston 24 acceleration that occurs when the capillary is first fired. FIG. 4 shows the drive piston 24 and damper piston 30 in the un-actuated or reset position. The working gas pressure causes the drive piston 24 to move out of this position since the area facing the capillary is greater than the opposite side by an amount equal to the cross sectional area of the shaft 34.

It becomes a piston with the diameter of the shaft 34 and will require an external reset force to counteract the force resulting from the pressurized gas in the drive piston cylinder 26. The source of the reset force is not shown in FIG. 4 but could be from a pneumatic device or a spring.

Figure 5:
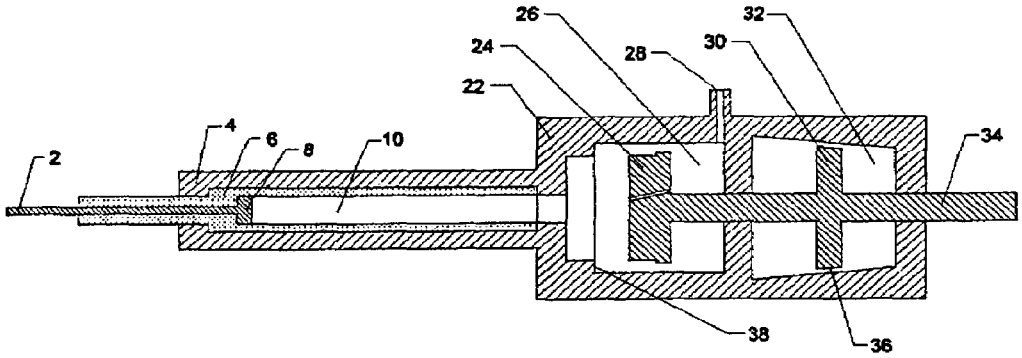
FIG. 5 is a simplified representation of a basic capillary driven actuator in its intermediate position during actuation.

The housing 22 has a tapered bore for damper piston 30 and the interior volume 32 is filled with hydraulic fluid 33. The gap 36 between the damper piston 30 and housing 22 is relatively large when the damper piston is in the un-actuated or reset position as shown in FIG. 4, but decreases as the damper piston moves through the partially actuated position as shown in FIG. 5. The hydraulic pressure in the tapered bore volume 32 behind the damper piston 30 must rise to the pressure needed to accelerate the hydraulic fluid 33 to the speed it must flow through the gap to accommodate the drive piston motion. This inertial force is usually much greater than the viscous forces allowing the viscous forces to be ignored for most cases.

Figure 6:
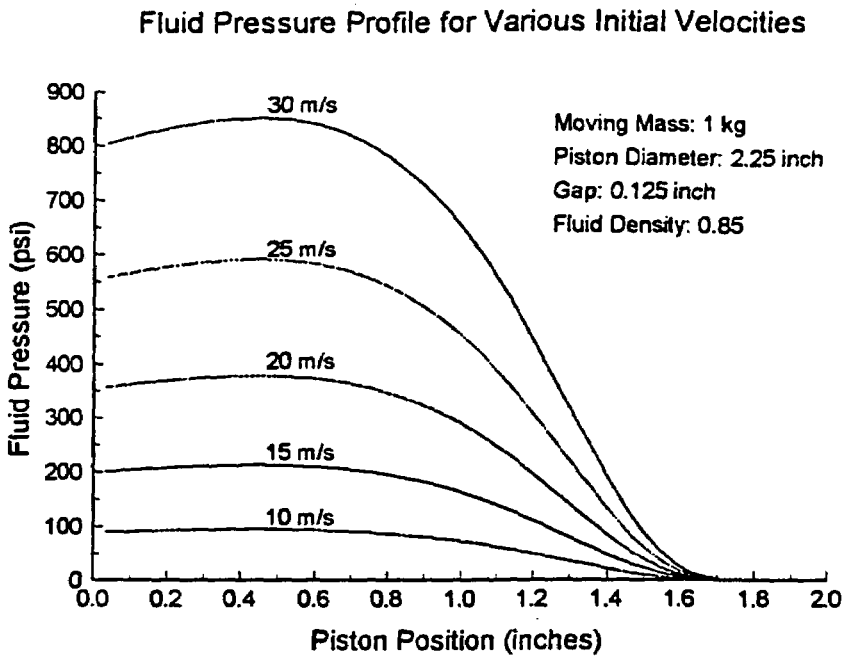
FIG. 6 is a graph showing the effect of initial velocity on hydraulic damper fluid pressure profile versus damper piston position.
Figure 7:
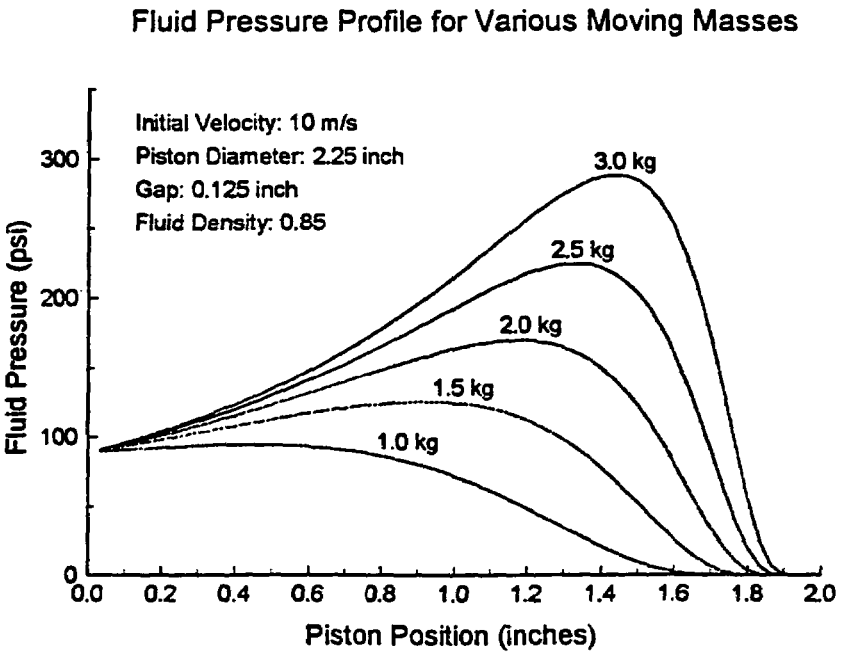
FIG. 7 is a graph showing the effect of mass on the hydraulic damper fluid pressure profile versus damper piston position.
Figure 8:
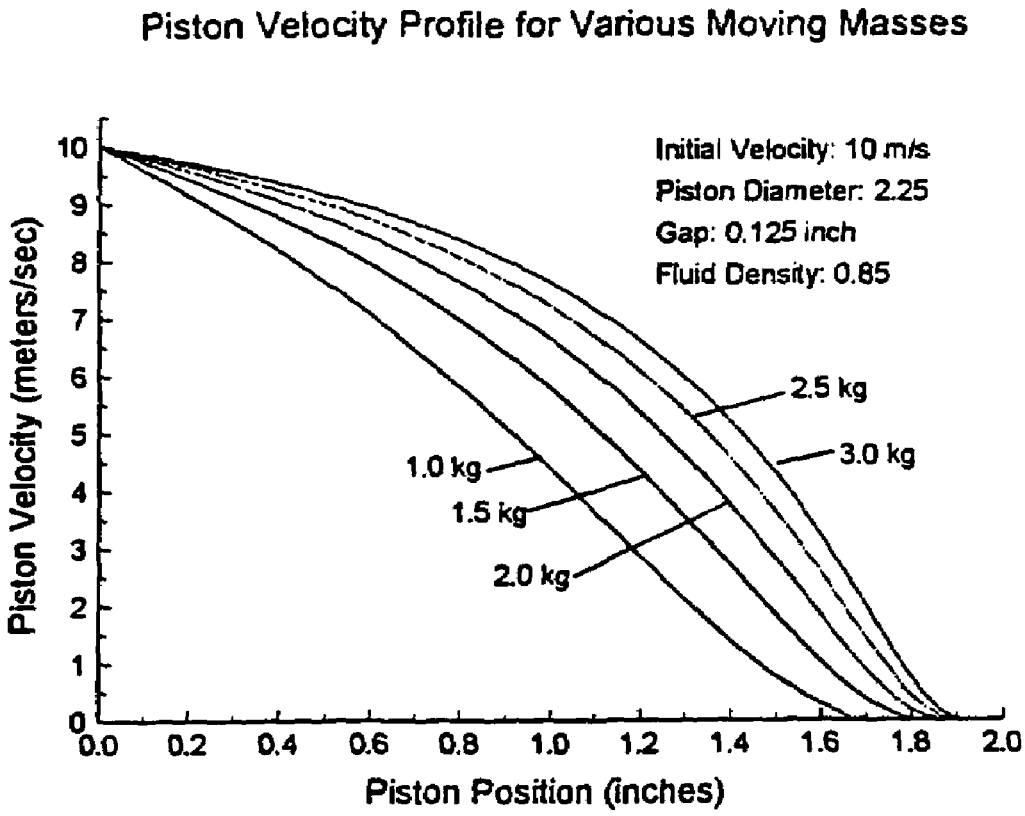
FIG. 8 is a graph showing the effect of mass on the damper velocity profile versus damper piston position.

A simple computer model simulating the damping action based only on the inertial forces shows some unique properties. FIG. 6 plots hydraulic pressure versus piston position for different initial velocities and shows that the distance required to stop a moving mass is nearly independent of initial velocity. FIG. 7, a similar plot for various masses, shows the damper is able to stop a wide range of masses in nearly the same distance. FIG. 8 plots piston velocity versus piston position and shows that a given embodiment stops a particular mass (1.0 kg) in a near linear fashion. These graphs all assume the piston motion has an initial velocity with no additional accelerating force from a drive piston. In actuality, residual drive forces cause the piston to slowly move to the far end. The simulation also does not account for the compressibility of the hydraulic fluid and piston flexing, which causes a slight oscillation in position. The simple computer model is, however, a useful tool to aid in the determination of the optimum damper dimensions for a specific application. The 2.25 inch piston diameter and 0.125 inch gap shown for the computer simulations are those chosen for a preferred embodiment by experimenting with the computer simulation.

Figure 9:
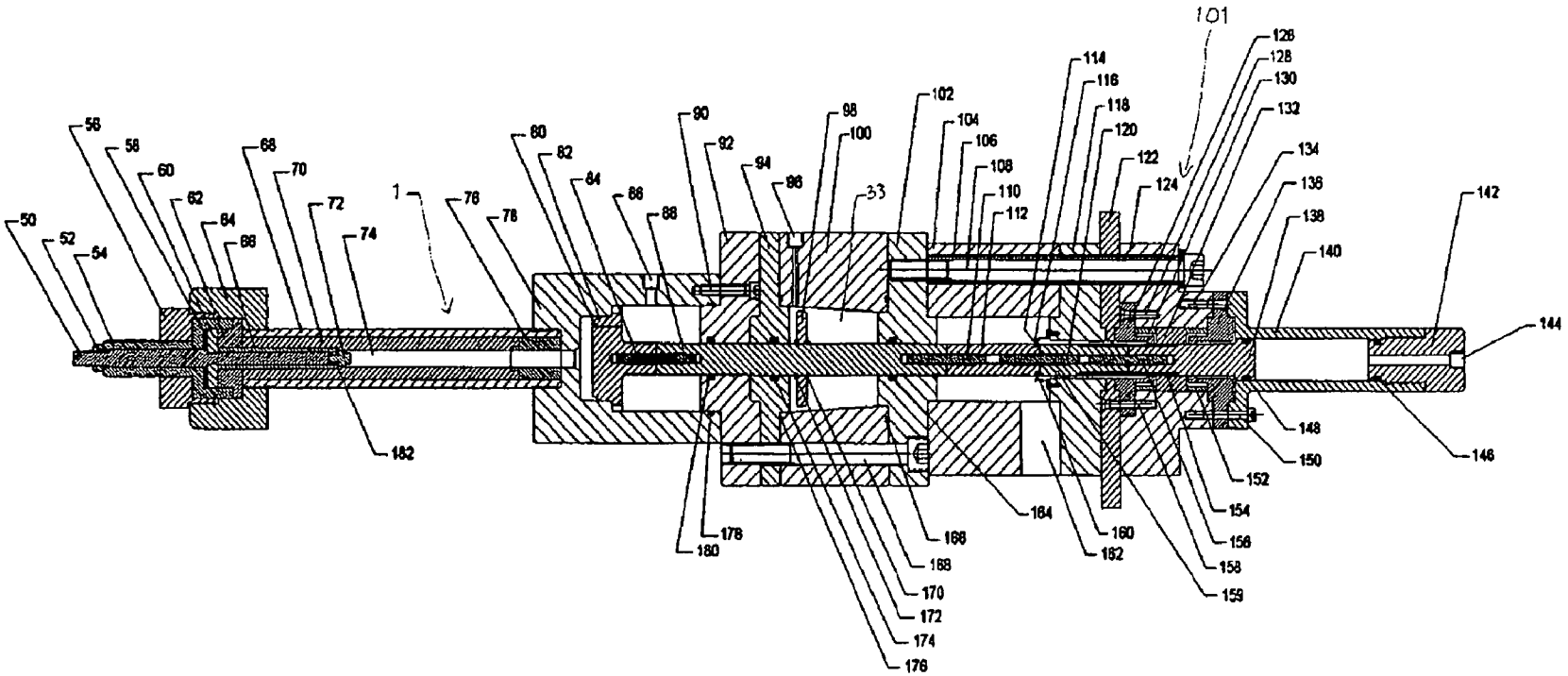
FIG. 9 is a cross sectional view of a preferred embodiment of the invention when used to drive a high speed switch.

A preferred embodiment shown in FIG. 9 is used as a fast closing, high voltage, and high current switch. This device consists of a boron nitride capillary liner 70 that has been shrunk fit into a steel capillary housing 68. The shrink fit is needed to keep the capillary liner in compression when high pressures exist in a capillary interior gas volume 74 as boron nitride, like most ceramics, does not have sufficient tensile strength to contain pressures that can momentarily approach 20,000 psi. Both a second electrode (cathode) 76 and a first electrode (anode) 72 are preferably, but not limited to, a tungsten alloy. The first electrode (anode) 72 is threaded to the end of a high voltage electrode 50 which passes through insulating tube 66, and insulators 62, 60, 58, and 54. Insulator 60 is split so that it is seated in a wide groove in the high voltage electrode 50. Insulator 58 is used as a shim to control the exact position of the high voltage electrode 50 and is held in place with a nut 52. The insulators 62, 60, 58, and 54 are held in the steel insulator housing 56 and 64, which is threaded onto the end of the capillary housing 68. A high temperature seal material 182 aids achievement of a pressure tight assembly.

The end of the capillary housing 68 threads into the drive piston housing 78, which contains a drive piston 82. The drive piston 82 fits both the smaller and larger bore diameters of the drive piston housing 78 but the larger diameter of the drive piston is segmented like the petals of a flower to allow the free flow of gas between the petals, equalizing the pressurize on both sides of the drive piston 82 once it has moved out of the smaller bore section of the drive piston housing 78.

A pressure port 86 in the housing provides a means of introducing the argon working gas. A small diameter pressure equalization passage 80 insures the working gas fills the capillary interior volume 74. The working gas is added through the port 86, and then released several times to purge the capillary volume 74 of air when filling for the first time. The port 86 may also be used during assembly to insert a tool to engage a petal of the drive piston 82 to prevent it from rotating, while attaching the armature damping section 88 to the drive piston 82 using a threaded stud 84.

A drive piston housing end 92 is attached to the drive piston housing 78 with circular pattern of screws, one of which 90 is shown. Seals 178 and 180 are used to ensure the drive piston housing 78 is pressure tight.

A damper piston housing 100 with end caps 94 and 102 form a tapered chamber containing a damper piston 98. The damper piston 98 is held in place on the armature damper segment 88 by retaining rings 170 and 172. A threaded fill port 96 allows the tapered chamber to be filled with hydraulic fluid 33 and, once filled, can be sealed with a threaded plug (not shown). Seals 164, 166, 174 and 176 are used to prevent the leakage of hydraulic fluid 33. The damper housing assembly 94, 100 and 102 can be held together with screws (not shown) to allow handling as a unit which is then mounted to the drive piston end cap 92 with a circular pattern of bolts, one of which 168 is shown.

An insulating switch support spacer 104 and insulating spacer end 118 electrically isolate all switch parts from the actuator parts. The armature insulating auxiliary switch contact segment 112 is secured to the armature damper segment with a threaded stud 110. The armature auxiliary switch contact segment contains a conductive ring 114 that electrically connects a pair of auxiliary switch contacts 116 and 160 that are used to indicate the actuator is in the un-actuated position. A view port 162 in the switch support spacer 104 allows the position of the auxiliary switch 114, 116, and 160 to be determined visually.

The auxiliary switch contact segment 112, the insulating armature main switch segment 159, and the insulating reset piston segment are joined by threaded studs 156 and 120. The segments slide through the main switch contacts 126 and 136. A conductive tube 154 over a portion of the piston segment 138 and the main switch segment 159 connects the main switch contacts 126 and 136 together by sliding through contact 136 when actuated. The contacts 126 and 136 are arrays of contact fingers around the conductive tube 154 that divide the switch current through multiple contact points and are arranged in a manner well known in the art of high current switches that generates magnetic forces between fingers that counteract the magnetic forces at the points of contact that would otherwise lift the contacts causing an arc.

The switch function is easily converted from a closing switch to an opening switch by changing the position of the conductive tube 154 so that it bridges the contacts 126 and 136 when in the reset position. Upon actuation, the conductive tube 154 slides out of contact 126 opening the switch. The resulting arc is quenched when the conductive tube 154 end slides into the arc quencher 132 using an extremely lossy arc technique. The spacers 130 and 152 hold the arc quencher 132 in position.

The switch contacts 126 and 136 are mounted to an insulating contact separator 124 by circular patterns of screws, one of each being shown 128 and 134. One switch terminal is a conductive plate 122, which is attached to contact 126 using a circular pattern of screws, one of which 158 is shown. The other switch terminal 140 is attached to contact 136 using a circular pattern of screws, one of which 150 is shown. The spacer 104, spacer end 118, switch terminal 122, and contact spacer 124 are all attached to the damper end cap 102 using a circular pattern of bolts, one of which 108 is shown. These bolts pass through insulating tubes 106 to avoid being a potential electrical breakdown path between the switch terminal 122 and the damper housing end 102 and all other conductive parts. Additionally, care must be taken to provide sufficient space between the bolt 108 and the switch contact 136 to assure no breakdown occurs.

The switch terminal 140 also serves as the cylinder for the reset piston 138. A threaded pressure port 144 in the end cap 142 provides a means of introducing a pressurized gas when needed to push all switch armature parts into the reset position. Seals 146 and 148 ensure a gas tight piston/cylinder assembly.

The high speed switch 101 depicted in FIG. 9 is normally in the reset position. This is accomplished by applying pressure to the reset port 144 with the working gas port 86 vented to the atmosphere. After the switch is fully in the reset position, which can be verified by electrical continuity between the auxiliary contacts 116 and 160, the working gas, typically, 150 psi argon, can be introduced through the working gas port 86. The energy storage capacitor 18 of FIG. 3, typically about 250 uF, is charged to approximately 4000 volts. The high speed switch is actuated by triggering the high voltage pulse generator 20 of FIG. 3 and simultaneously venting the working gas port 86 and the reset piston port 144 to the atmosphere. Under these conditions, the switch closes in approximately 1500 microseconds. Much faster speeds are achieved with a larger capillary and increased energy stored in the capacitor 18, lighter materials for the moving parts, and reduced dead space in the front of the drive piston 82. An instrumented opening switch version with a larger capillary using a 300 uf capacitor charged to 8200 volts may interrupt a 9000 ampere, 6000 volt DC circuit in less than approximately 500 microseconds with peak piston speeds exceeding about 20 meters per second.

While the invention has been described with reference to specific embodiments, modifications and variations of the invention may be constructed without departing from the scope of the invention.

The invention claimed is:

1. High speed actuating apparatus comprising:

a capillary device further comprising an energy storage capacitor, a high voltage pulse generator connected to the energy storage capacitor, an electrode connected to the high voltage pulse generator, an anode connected to the electrode, a capillary housing having a closed end and an open end and holding the anode near the closed end, a capillary liner within the capillary housing, a capillary volume within the capillary liner, and a cathode at the open end of the capillary device opposite the electrode, a housing enclosing the open end of the capillary device, a drive cylinder within the housing, a working gas within the drive cylinder and the capillary volume, a drive piston within the drive cylinder, a damper cylinder connected to the housing, a damper piston within the damper cylinder, hydraulic fluid within the interior volume, and a shaft connecting the drive piston to the damper piston.

2. The apparatus of claim 1, further comprising a drive cylinder pressure port for introducing working gas into the drive cylinder.

3. The apparatus of claim 1, further comprising a pressure equalization passage through the drive piston.

4. The apparatus of claim 1, wherein the drive cylinder has a step increase in bore diameter.

5. The apparatus of claim 4, wherein the drive piston has an enlarged portion within the increased bore that is segmented like the petals of a flower.

6. The apparatus of claim 1, further comprising a reset source for resetting the drive piston near the open end of the capillary housing.

7. The apparatus of claim 1, wherein the damper cylinder has a tapered bore.

8. The apparatus of claim 1, wherein the capillary liner is shrunk fit into the capillary housing.

9. The apparatus of claim 1, wherein the high voltage pulse generator is an inductor.

10. The apparatus of claim 1, further comprising a pressure equalization passage through the drive piston for ensuring the working gas in the drive cylinder fills the capillary volume.

11. A high speed actuator and high speed switch apparatus comprising:

a capillary tube having a capillary housing, a capillary insulating liner within the capillary housing, a capillary volume within the capillary liner, a closed end and an open opposite end of the capillary tube, an energy storage capacitor, a high voltage switch connected to the energy storage capacitor, a first electrode connected to the high voltage switch and mounted within the capillary volume, an anode connected to the electrode, a second electrode near the open end of the capillary tube opposite the first electrode, a drive housing enclosing the open cathode end of the capillary tube, a drive cylinder within the drive housing, a working gas within the drive cylinder and the capillary tube, a drive piston within the drive cylinder, a damper cylinder connected to the drive housing, a damper piston within the damper cylinder, hydraulic fluid within the damper cylinder, a shaft connecting the drive piston to the damper piston, a drive cylinder pressure port connected to the drive housing for introducing working gas into the drive cylinder, a pressure equalization passage through the drive piston, a high speed switch connected to the shaft for operating the high speed switch when the drive piston drives the shaft away from the capillary tube, and a reset connection to the shaft for driving the shaft toward the capillary tube.

12. The apparatus of claim 11, wherein the drive cylinder has a smaller bore near the capillary tube, an outward step at an end of the smaller bore away from the capillary tube, and a larger bore extending from the step.

13. The apparatus of claim 12, wherein the drive piston has a first smaller section fitting in the smaller bore and a second larger section fitting in the larger bore.

14. The apparatus of claim 12, wherein the second larger section has spaced edge portions for flowing working gas around the driving piston.

15. The apparatus of claim 11, wherein the damper cylinder has a sloping bore sloping inward from a larger bore section toward the capillary tube for slowing flow of the hydraulic fluid around the damper piston as the damper piston travels away from the capillary tube.

16. The apparatus of claim 11, wherein the high speed switch comprises a shaft extension on the shaft, a conductor on the shaft extension, a shaft extension housing on the shaft extension and first and second spaced contacts in the shaft extension housing for bridging the contacts with the conductor.

17. The apparatus of claim 16, wherein the shaft extension housing surrounds the shaft extension, the conductor is a conductive sleeve on the shaft extension, and wherein the spaced contacts are annular and surround the shaft extension.

18. The apparatus of claim 17, wherein the high speed switch is a circuit breaker, wherein the conductive sleeve bridges and connects the contacts when the shaft and the drive piston are in a reset position near the capillary tube, and further comprising an insulating contact separator and an arc quencher in the shaft extension housing between the annular contacts.

19. The apparatus of claim 18, wherein the reset further comprises a reset chamber surrounding an end of the shaft extension remote from the capillary tube and a gas port connected to the reset chamber for moving the shaft toward the capillary chamber and into the reset position.

20. A method of high speed actuating comprising:

providing a capillary tube with a capillary housing, a capillary liner within the capillary housing, a capillary volume within the capillary liner, a closed end and an open end of the capillary tube opposite the electrode closed end, providing an energy storage device, providing a high voltage switch connecting the high voltage switch to the energy storage device, providing a first electrode in the closed end of the capillary tube and connecting a conductor to the high voltage switch and connecting the first electrode to the conductor, providing a second electrode at the open end of the capillary tube, providing a housing enclosing the open cathode end of the capillary tube, providing a drive cylinder within the housing, providing a damper cylinder connected to the housing, providing a damper piston within the damper cylinder, providing a shaft connecting the drive piston to the damper piston, filling the drive cylinder within the housing and the capillary volume with a working gas, filling the damper cylinder with hydraulic fluid, operating the high voltage switch, heating and expanding the working gas in the capillary volume by discharging electrical energy from the energy storage device between the first and second electrodes, accelerating the drive piston from an initial position with the expanding working gas, flowing the expanding working gas around the drive piston, decelerating the drive piston with hydraulic force on the damper piston, and returning the drive piston to the initial position by applying a reset force to the shaft.

21. The method of claim 20, wherein the providing the high voltage switch comprises providing a high voltage pulse generator, wherein the providing the first and second electrodes comprises providing an anode at the closed end and providing an annular cathode at the open end.

22. The method of claim 20, further comprising providing the drive piston with a step increase in bore diameter away from the capillary tube, and wherein the drive piston has a complementary step increase in diameter, and further comprising providing the increased diameter portions of the drive piston and passageways cooperating between the drive cylinder for flowing expanding working gas around the drive piston.

23. The method of claim 20, further comprising providing a tapered bore in the damper cylinder tapering away from the drive cylinder.

24. The method of claim 20, further comprising shrink fitting the capillary housing around the capillary liner.

25. The method of claim 20, further comprising providing a pressure equalization passage through the drive piston for ensuring the working gas fills the capillary volume from the drive cylinder.

26. The method of claim 20, further comprising providing spaced contacts around the shaft, providing a conductive sleeve on the shaft for spanning the spaced contacts for moving the sleeve with the shaft with respect to the contacts to complete or break a circuit between the contacts and the sleeve, providing an arc suppressor surrounding the shaft for suppressing an arc when the shaft moves the sleeve out of contact with one of the contacts.

* * * * *